United States Patent [19]

Martino

[11] 4,151,903

[45] May 1, 1979

[54] SUBMERSIBLE PUMP RAISING AND LOWERING TOOL

[76] Inventor: Anthony S. Martino, 66 Howard St., Pittsfield, Mass. 01201

[21] Appl. No.: 816,746

[22] Filed: Jul. 18, 1977

[51] Int. Cl.[2] ..... B65H 57/00

[52] U.S. Cl. ..... 193/1; 254/134.3 R; 254/190 R

[58] Field of Search ..... 254/190 R, 190 C, 193, 254/195, 197, 134.3 R, 134.3 PA; 242/157 R; 193/1; 24/115 R; 248/77, 78; 214/1 PA; 226/196

[56] References Cited

U.S. PATENT DOCUMENTS

| | | | |
|---|---|---|---|
| 212,876 | 3/1879 | Waterworth | 254/190 R |
| 1,735,301 | 11/1929 | Short | 254/134.3 R |
| 2,459,621 | 1/1949 | Cobb | 254/195 X |
| 2,628,071 | 2/1953 | Williams | 254/195 |
| 2,629,768 | 2/1953 | Beil | 254/190 R X |
| 3,172,642 | 3/1965 | Eitel | 254/190 R X |
| 3,968,952 | 7/1976 | Newell | 254/134.3 R |

*Primary Examiner*—Evon C. Blunk
*Assistant Examiner*—James L. Rowland
*Attorney, Agent, or Firm*—Daniel Jay Tick

[57] ABSTRACT

A ladder type framework is removably supported on the open rim of a pipe embedded upright in the ground and extending therefrom. The frame has a plurality of spaced cross-members supported in generally horizontal position. A tube, cable, line, and the like, is supported on a selected cross-member of the frame in spaced relation with the rim of the pipe to permit such tube, cable, line, and the like, to be raised and lowered in the pipe spaced from the rim to prevent abrasion by the rim.

1 Claim, 4 Drawing Figures

SUBMERSIBLE PUMP RAISING AND LOWERING TOOL

BACKGROUND OF THE INVENTION

The present invention relates to a submersible pump raising and lowering tool. More particularly, the invention relates to a submersible pump raising and lowering tool for selectively raising and lowering submersible pumps without snags in a pipe embedded substantially upright in the ground.

Objects of the invention are to provide a submersible pump raising and lowering tool of simple structure, which is inexpensive in manufacture, assembled and disassembled with facility and convenience, used with facility, convenience and safety, and functions efficiently, effectively and reliably to prevent abrasion of a tube, cable, line, and the like, extending into a pipe embedded in the ground thereby preventing damage of such tube, cable, line, and the like, to eliminate snags in a submersible pump affixed to the end of such tube, and the like, and raised or lowered in the pipe.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
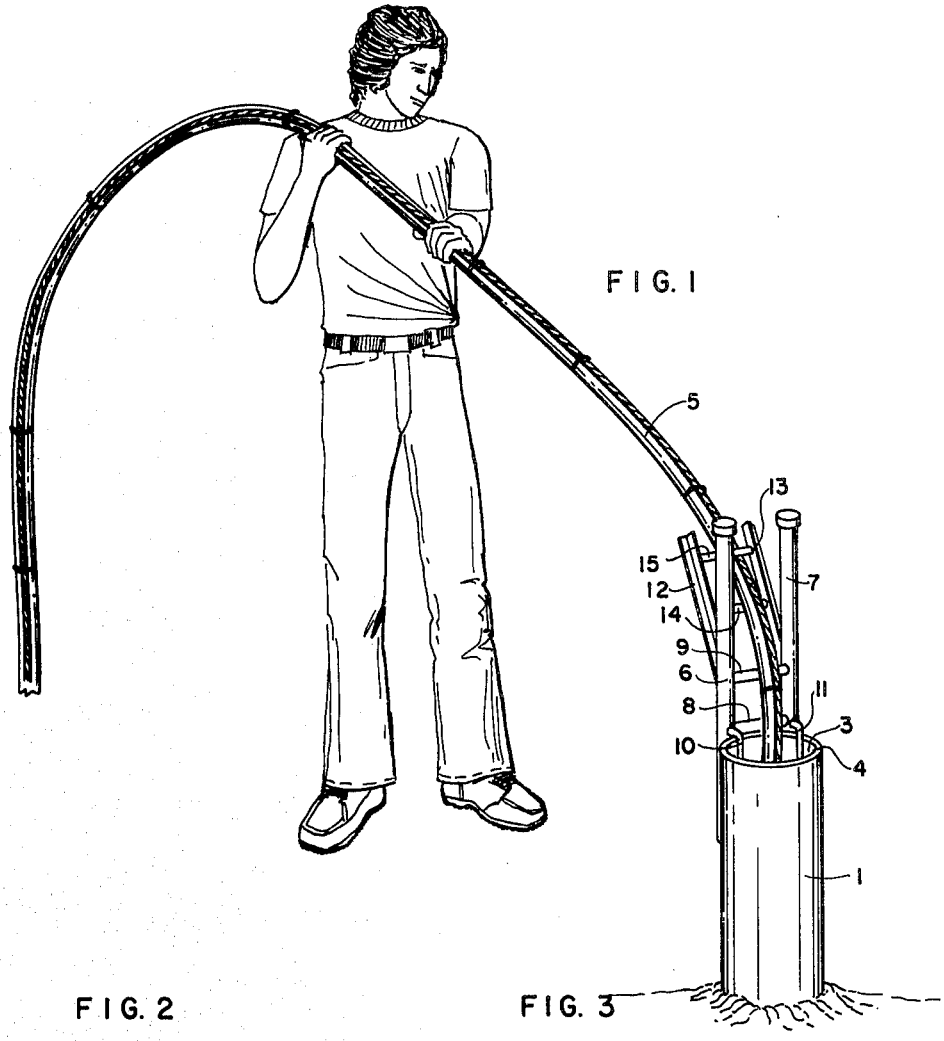
FIG. 1 is a perspective view of an embodiment of the submersible pump raising and lowering tool of the invention in use.

The submersible pump raising and lowering tool of the invention functions to selectively raise and lower submersible pumps without snags in a pipe 1 (FIG. 1) embedded substantially upright in the ground 2. The pipe 1 has an open end 3 above the ground 2 with a rim 4 therearound, as shown in FIG. 1.

The tool of the invention prevents the rim 4 at the open end 3 of the pipe 1 from abrading, cutting, or otherwise damaging, a tube, cable, line, or the like 5 (FIG. 1) and thus avoids snags in the submersible pump connected to the end of said tube, cable, line or the like, in the pipe 1, as said tube, cable, line, and the like, is raised and lowered in said pipe.

Figure 2:
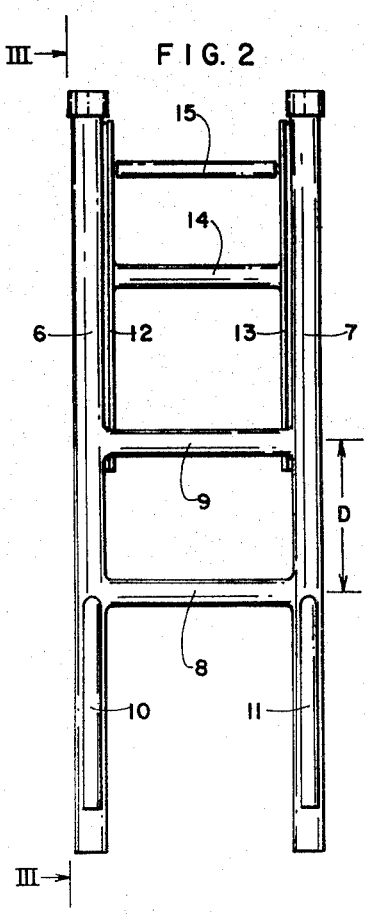
FIG. 2 is a view, on an enlarged scale, of the embodiment of FIG. 1.

The submersible pump raising and lowering tool of the invention comprises a first pair of rail-type support members 6 and 7 (FIGS. 1 and 2).

Figure 3:
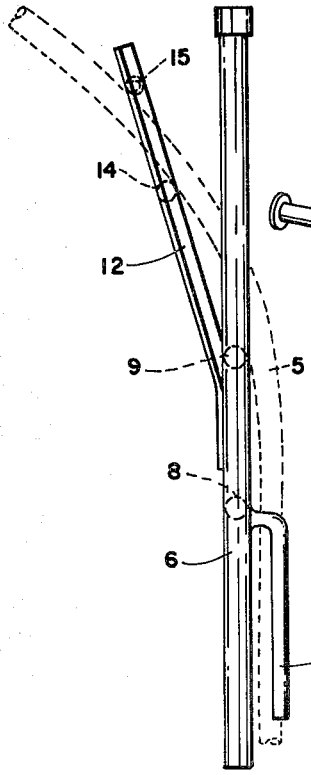
FIG. 3 is a view, taken along the lines III—III, of FIG. 2.

First cross-members 8 and 9 are affixed to, and extend substantially perpendicularly between, the first pair of members 6 and 7 in spaced relation, as shown in FIGS. 1 to 3, and support said support members in spaced substantially parallel relation, as shown in FIGS. 1 and 2.

A pair of inverted substantially L-shaped brackets 10 and 11 are affixed to the support members 6 and 7, respectively, for mounting said support members on the pipe 1 at the open end 3 thereof with the support members extending substantially parallel to the axis of the pipe, as shown in FIG. 1. Thus, the cross-members 8 and 9 extend coplanarly in a first plane substantially parallel to the axis of the pipe 1, with the first cross-members extending substantially perpendicularly to said axis. The plane is formed by the support members 6 and 7 and the cross-members 8 and 9.

A second pair of rail-type mounting members 12 and 13 are provided (FIGS. 1 to 4). The rail-type mounting member 12 is affixed to the support member 6 at an upwardly opening acute angle therewith and the rail-type mounting member 13 is affixed to the support member 7 at the same upwardly opening acute angle therewith as that of the rail-type mounting member 12. The mounting members 12 and 13 extend coplanarly, in a second plane, formed by said mounting members, at an angle with the first plane, as shown in FIGS. 1 and 3. The mounting members 12 and 13 are affixed to the support members 6 and 7 at a predetermined distance D from the brackets 10 and 11 thereby spacing said mounting members from the rim 4 of the pipe 1.

Figure 4:
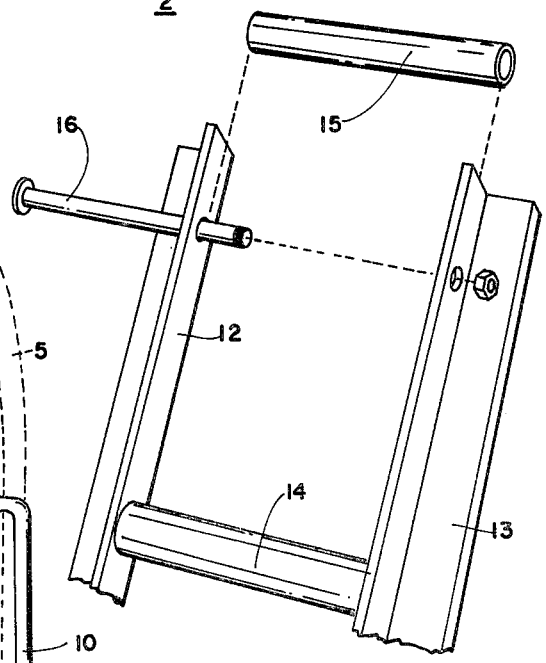
FIG. 4 is an exploded perspective view, on an enlarged scale, of part of the embodiment of FIG. 1.

Second cross-members 14 and 15 are affixed to, and extend substantially perpendicularly between, the second pair of members 12 and 13, as shown in FIGS. 1, 2 and 4, in spaced relation, coplanarly in the second plane. The second cross-members 14 and 15 extend substantially perpendicularly to the axis of the pipe 1 for supporting the tube, cable, line, and the like 5 (FIG. 1) in spaced relation with the rim 4 of the pipe, as shown in FIG. 1, to permit said tube, cable, line, and the like, to be raised and lowered in the pipe, spaced from said rim to prevent abrasion or damage by said rim.

As shown in FIGS. 2 and 4, the second cross-member 15 is preferably rotatably mounted, so that it rolls when the tube, cable, line, and the like 5 is moved thereon. This may be accomplished by mounting the second cross-member 15 via a bolt 16 extending coaxially therethrough and coupled to the second pair of rail-type mounting members 12 and 13 in the manner shown in FIG. 4.

While the invention has been described by means of a specific example and in a specific embodiment, I do not wish to be limited thereto, for obvious modifications will occur to those skilled in the art without departing from the spirit and scope of the invention.

I claim:

1. A tool for selectively raising and lowering submersible pumps without snags in a pipe embedded substantially upright in the ground, said pipe having an open end above the ground with a rim therearound, said tool comprising a first pair of rail-type support members;

first cross-members affixed to and extending substantially perpendicularly between the first pair of members in spaced relation and supporting said support members in spaced substantially parallel relation;

bracket means comprising a pair of inverted substantially L-shaped brackets affixed to the support members for mounting said support members on the pipe at the open end thereof, said support members extending substantially parallel to the axis of the pipe so that the cross-members extend coplanarly in a first plane, the first plane being substantially parallel to said axis, said first cross-members extending substantially perpendicularly to said axis;

a second pair of rail-type mounting members each affixed to a corresponding one of the support members at an upwardly opening acute angle therewith, said mounting members extending coplanarly in a second plane at an angle with the first plane, said mounting members being affixed to said support members at a predetermined distance from the bracket means whereby said mounting members are spaced from the rim of the pipe; and second cross-members affixed to and extending substantially perpendicularly between the second pair of members in spaced relation coplanarly in the second plane, said second cross-members extending substantially perpendicularly to the axis of the pipe for supporting a tube, cable, line, and the like, in spaced relation with the rim of the pipe to permit said tube, cable, line, and the like, to be raised and lowered in the pipe spaced from said rim to prevent abrasion by said rim, said tube, cable, line, and the like, extending out of said pipe, passing over one of the first cross-members between the first support members, over one of the second cross-members farther above the rim of said pipe than said one of said first cross-members and under another of said second cross-members farther above said rim of said pipe than said one of said second cross members.

* * * * *